US006560437B2

(12) United States Patent
Kobaru et al.

(10) Patent No.: US 6,560,437 B2
(45) Date of Patent: May 6, 2003

(54) IMAGE FORMING APPARATUS WITH SECOND POWER SOURCE FOR CHARGE ELIMINATION MEANS

(75) Inventors: Yasunari Kobaru, Shizuoka (JP); Takashi Narahara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/925,472

(22) Filed: Aug. 10, 2001

(65) Prior Publication Data

US 2002/0051660 A1 May 2, 2002

(30) Foreign Application Priority Data

Aug. 11, 2000 (JP) ..... 2000-244176
Aug. 3, 2001 (JP) ..... 2001-235721

(51) Int. Cl.[7] ..... G03G 15/14; G03G 15/20
(52) U.S. Cl. ..... 399/315; 399/322; 399/324
(58) Field of Search ..... 399/315, 316, 399/322, 324, 328, 397, 400

(56) References Cited

U.S. PATENT DOCUMENTS 5,379,099 A * 1/1995 Senba et al. ..... 399/315
5,812,920 A * 9/1998 Mizude et al. ..... 399/397 X
5,926,683 A * 7/1999 Yuminamochi et al. . 399/315 X

* cited by examiner

*Primary Examiner*—William J. Royer
(74) *Attorney, Agent, or Firm*—Fitzpatrick, Cella, Harper & Scinto

(57) ABSTRACT

In a conventional type of an image forming apparatus, when the top end of the paper whose charge is eliminated is brought into contact with the roller, or when the potential of the pressure roller is fluctuated by a separating discharge of the paper rear end, black spots phenomenon sometimes occurs at a portion in which the potential of the roller was lowered. It is provided, an image forming apparatus for preventing black spots of toner.

21 Claims, 8 Drawing Sheets

IMAGE FORMING APPARATUS WITH SECOND POWER SOURCE FOR CHARGE ELIMINATION MEANS

BACKGROUND OF THE INVENTION

1. Field of the Invention

The present invention relates to an image forming apparatus such as a printer and a copier which adopts an electrophotographic system.

2. Related Background Art

Conventionally, an image forming apparatus adopting an electrophotographic system comprises: a latent image bearing body for bearing a latent image; developing means for visualizing the latent image as a developer image by supplying a developer to the latent image bearing body; transferring means for transferring the developer image onto a recording medium; and fixing means for fixing the developer image on the recording medium by heating and pressurizing the recording medium which bears the developer image.

Further, in such an image forming apparatus, there has been known and put into practice an image forming apparatus comprising residual charge elimination means which charge-eliminates the recording medium by applying a bias from a power source to the recording medium after the transfer of the developer image to the recording medium by the transferring means.

For example, in such an image forming apparatus, as shown in FIG. 7, as a method of separating a paper 114, which is the recording medium after the toner image which is the developer image was transferred, from a photosensitive drum 103 which is the latent image bearing body, a method is generally adapted wherein, by applying a bias voltage of the polarity opposite to the bias applied (hereinafter, referred to as a residual charge elimination bias) to the transferring roller 107 which is transferring means, a charge on the paper 114 is charge-eliminated and an absorption force between the photosensitive drum 103 and the paper 114 is weakened.

A residual charge elimination needle 120 has a current-limiting resistor 121 having a resistance of 5 Ω to 50 Ω connected to a power source 122 in series to prevent a current leakage due to a high voltage. In the present example, in order to prevent the bias applied to the transferring roller 107 from leaking to the residual charge elimination needle 120, a residual charge elimination needle holder 120*a* for shielding between the transferring roller 107 and the residual charge elimination needle 120 is installed. Note that, in general, the above described method of separating the paper 114 from the photosensitive drum 103 by the residual charge elimination needle 120 is used in combination with a method of abutting a separating claw (not shown) against the photosensitive drum 103 and forcing the paper to be stripped off after transfer in order to enhance separability of a thin paper from the photosensitive drum 103.

In a fixing apparatus 117 provided for such an image forming apparatus, as shown in FIG. 7, the paper 114 which bears an unfixed toner image T is passed through a nip formed by a roller heated from the inside by a heater 133 which is heating means, thermal fixing means 131 which is a film-shaped fixing member and a pressure roller 132 which is a pressing body and pressure-welded to the thermal fixing means 131, and heated and pressurized so that the unfixed toner image T is fixed on the paper 114.

In recent years, in order to solve an offset problem in such a fixing apparatus 117, there have been on the increase apparatuses having such a constitution that, on the surfaces of the thermal fixing means 131 and the pressure roller 132, a potential difference is induced in such a direction as to press an unfixed toner image on the paper 114 against the paper 114, the offset toward the thermal fixing means 131.

For example, as for the fixing apparatus of the above described constitution, there are such apparatuses available wherein, by applying a bias (if a negative toner, −100 V to −2000 V) of the same polarity as the toner (unfixed toner) to the metal core of the fixing roller, a potential which repels the toner is induced on the surface, while, on the other hand, the pressure roller disperses an electrically conductive agent on a surface layer fluororesin layer and an elastic layer to make it as a medium resistive roller (having a surface resistance of $10^7$ Ω to $10^{12}$ Ω) and, by connecting a diode to the metal core, the potential difference with the fixing roller is maintained.

Or there are such apparatuses available, wherein, as shown in FIG. 7, the thermal fixing means 131 (for example, the fixing roller metal core) is grounded (of course, it may be applied with a bias of the same polarity as the toner), and the surface resistance of the pressure roller 132 is made a low resistive not more than $10^6$ Ω, and an electrode of an electrically conductive brush 134 and the like applied with a bias (hereinafter, referred to as a pressure bias) of the polarity reverse to the toner by a power source 136 is brought into contact with the surface of the pressure roller 132, so that the potential difference with the thermal fixing means 131 is maintained.

This apparatus comprises a current-limiting resistor 135 of 100 MΩ to 1000 MΩ which controls a large electric current so as not to flow even if the pressure bias of high voltage continues to be applied and, compared to the current-limiting resistor 121 of the residual charge elimination bias, a high value resistor is used for the current-limiting resistor 135.

In this way, by generating a potential difference in such a direction as to press the toner on the paper, there is no more to coat a surface lubricant such as a silicone oil and the like on the surface of the thermal fixing means as in the past or to make a cleaning member abut against the thermal fixing means or the pressure roller.

As a result, there are no more accidents such as an oil leakage and the like and a user's labor to periodically replace the cleaning member is eliminated.

FIG. 8 is a chart showing a timing of the residual charge elimination bias at the time when the paper 114 passes through on the residual charge elimination needle 120 with the position of the residual charge elimination needle 120 as a reference. Note that, in FIG. 8, an arrow mark is a top end of the paper 114.

The residual charge elimination bias adequately eliminates the charge on the paper and applies a bias of −0.5 kV to −1.5 kV (hereinafter, referred to as a low level) from the top end of the paper to the halfway of the image so that the paper does not stick and pile by a guide member installed between the transferring portion and the fixing portion. While, at the paper rear end, it is preferable to strongly charge-eliminate the paper by a bias of −2 kV to −3 kV (hereinafter, referred to as high level) so that the paper does not jump up to allow the image to rub against the base of a cartridge.

By the way, usually, in the miniaturized apparatus, the paper is arranged so as to stretch across the transferring portion and the fixing portion and, when such an image forming apparatus as described above is sued under high humidity, because the paper is humidified under high humidifying circumstances, the potential of the pressure roller is lowered by a strong bias applied to the residual charge elimination needle so that the paper rear end does not jump up after the toner image is transferred on the paper. For this reason, there were some cases where a force to retain the unfixed toner image on the paper runs out and black spots phenomenon on a paper (hereinafter merely referred to as black spots) occurs at the fixing portion.

That is, in the case where the fixing apparatus is an apparatus wherein the surface resistance of the pressure roller is set not more than $10^6$ Ω and the bias of the polarity reverse to the toner is applied to the pressure roller, when a strong bias of the residual charge elimination needle is applied to the paper rear end as shown in FIG. 9, the potential of the humidified paper is lowered (B of FIG. 9). Incidentally, if the paper rear end passes through the residual charge elimination needle, a charge is newly supplied from the pressure roller and the potential of the paper becomes the same as the potential applied to the pressure roller.

Further, A, C of FIG. 9 show the fluctuations of the pressure roller potential at the moment when the paper reaches the fixing nip and at the moment when the paper leaves from the fixing nip, respectively.

In this way, when the top end of the paper whose charge is eliminated is brought into contact with the roller, or when the potential of the pressure roller is fluctuated by a separating discharge of the paper rear end, the black spots occur sometimes at a portion in which the potential of the roller was lowered.

SUMMARY OF THE INVENTION

It is an object of the present invention to control the potential fluctuation of the fixing member and provide an image forming apparatus for preventing black spots of toner.

It is another object of the present invention to provide image forming apparatus, comprising an image bearing body; transferring means for transferring a toner image on said image bearing body to a recording medium; fixing means for fixing an unfixed toner image transferred on a recording medium by said transferring means on the recording medium; voltage applying means for applying a voltage to a second fixing member which is not brought into contact with an unfixed toner image of said fixing means; and residual charge elimination means for charge-eliminating a recording medium before being fixed by said fixing means, in which said fixing means comprises first and second fixing members for holding and conveying the recording medium, at least a recording medium of the maximum size exists by extending from said residual charge elimination means to said fixing means, said voltage applying means comprises a first power source and a first resistor connected to said first power source in series, a voltage is applied to said second fixing member by said first power source through said first resistor, said residual charge elimination means comprises a second power source and a second resistor connected to said second power source in series, a voltage is applied to the recording medium by said second power source through said second resistor, and when the voltage value of said first power source is taken as $V_0$, the resistance value of said first resistor as $R_0$, the voltage value of said second power source as $V_1$, and the resistance value of said second resistor as $R_1$, there is a relation represented by $V_0 \cdot R_1 > V_1 \cdot R_0$.

It is another objected of the present invention to provide an image forming apparatus, comprising an image bearing body; transferring means for transferring a toner image on said image bearing body onto a recording medium; fixing means for fixing an unfixed toner image transferred on a recording medium by said transferring means on the recording medium; voltage applying means for applying a voltage to a second fixing member which is not brought into contact with an unfixed toner image of said fixing means; and residual charge elimination means for charge-eliminating a recording medium before being fixed by said fixing means, in which said fixing means comprises first and second fixing members for holding and conveying the recording medium, at least the recording medium of the maximum size exists by extending from said residual charge elimination means to said fixing means, said voltage applying means comprises a power source, and a resistor and capacitor which are connected to said power source in series, and a voltage between said resistor and said capacitor is applied to said second fixing member.

It is another objected of the present invention to provide an image forming apparatus, comprising an image bearing body; transferring means for transferring a toner image on said image bearing body onto a recording medium; fixing means for fixing an unfixed toner image transferred on a recording medium by said transferring means on the recording medium; voltage applying means for applying a voltage to a second fixing member which is not brought into contact with an unfixed toner image of said fixing means; residual charge elimination means for charge-eliminating a recording medium before being fixed by said fixing means; and an electrically conductive member brought into contact with the recording medium between said residual charge elimination means and said fixing means, in which said fixing means comprises first and second fixing members for holding and conveying the recording medium by pressure-contacting portions mutually pressure-contacted, at least the recording medium of the maximum size exists by extending from said residual charge elimination means to said fixing means, said voltage applying means stops applying the voltage to said second fixing member when the rear end of the recording medium reaches the pressure welding portion of said fixing means, and said electrically conductive member is grounded through the capacitor.

Still another object of the present invention will be evident from the following description.

DETAILED DESCRIPTION OF THE PREFERRED EMBODIMENTS

Embodiments of the present invention will be described with reference to the accompanying drawings.

(First Embodiment)

First, the first embodiment of the present invention will be described.

Figure 1:
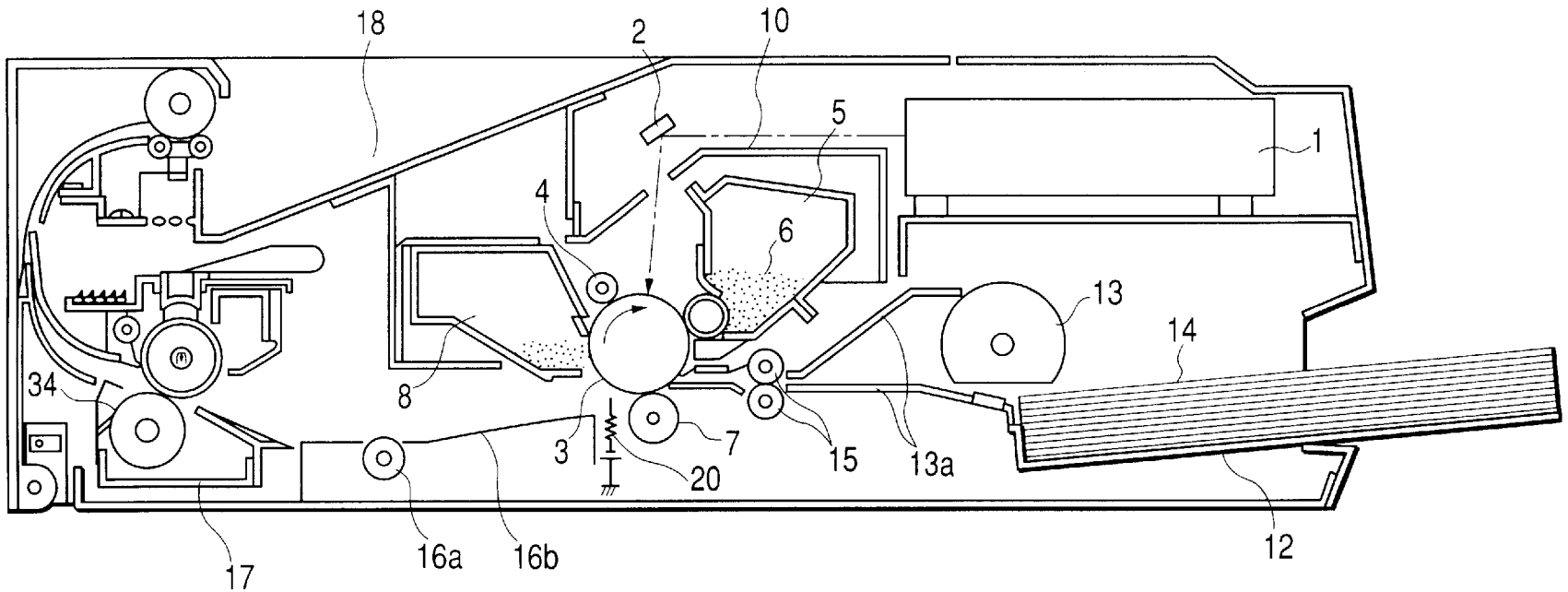
FIG. 1 is a view showing an image forming apparatus of an embodiment of the present invention.

FIG. 1 is a cross sectional view showing a schematic block diagram of a laser beam printer (hereinafter, a printer) which is one example of the image forming apparatus according to the present embodiment. Such a printer is of an image forming apparatus of a type using a negative toner and executing a reverse developing.

Such a printer comprises, as shown in FIG. 1, a scanner unit 1 comprising optical means and scanning means for irradiating and scanning a laser light transmitted according to image information and a process cartridge 10 built-in with main image forming means.

The process cartridge 10 comprises a photosensitive drum 3 which is an image bearing body for bearing a latent image and a toner image as image forming means, a roller charging device 4 composed of a semiconductor rubber, developing means 5 for developing the latent image by supplying a toner 6 on the photosensitive drum 3 and a cleaner 8 for eliminating a waste toner from the photosensitive drum 3.

The photosensitive drum 3 rotates in an arrow mark direction and, after being uniformly charged on its surface by the roller charging device 4, an electrostatic latent image is allowed to be formed on its surface by being irradiated with the laser light transmitted from the scanner unit 1 through a mirror 2.

The electrostatic latent image is provided with a toner by the developing means 5 and visualized as a toner image., On the other hand, a paper 14 which is a recording medium inside a paper feed cassette 12 is separated and fed by one sheet each by a paper feed roller 13 and a separating pad (not shown) in opposition to the paper feed roller 13, and the fed paper 14 is conveyed to one pair of resist rollers 15 along upper and lower guides 13*a*. The resist rollers 15 stop until the paper 14 comes, to which the top end of the paper 14 hits and a biased traveling of the paper 14 is corrected. Subsequently, the resist rollers 15 convey the paper 14 to a transferring portion in such a manner that it synchronizes with the top end of the image formed on the photosensitive drum 3. Note that, in the present embodiment, a paper feed sensor (not shown) is installed in the vicinity of the resist rollers 15 so that a paper feeding state, a paper jam and a length of the paper can be detected.

The paper 14 conveyed to the transferring portion in the above manner is given a charge of the polarity reverse to the toner from a transferring roller 7 which is transferring means from a back side of the paper 14, and the toner image formed on the photosensitive drum 3 is transferred on the paper 14. The paper 14 transferred with this toner image is conveyed to a fixing apparatus 17 which serves as fixing means by a conveying roller 16*a* and a conveying guide 16*b*, and the fixing apparatus 17 dissolves and fixes the toner image on the paper 14 onto the paper 14 by heat and pressure, thereby making it a recorded image. The paper 14 after the image is fixed is discharged to, for example, a discharging tray 18 through each conveying roller selected by a flapper (not shown).

Figure 2:
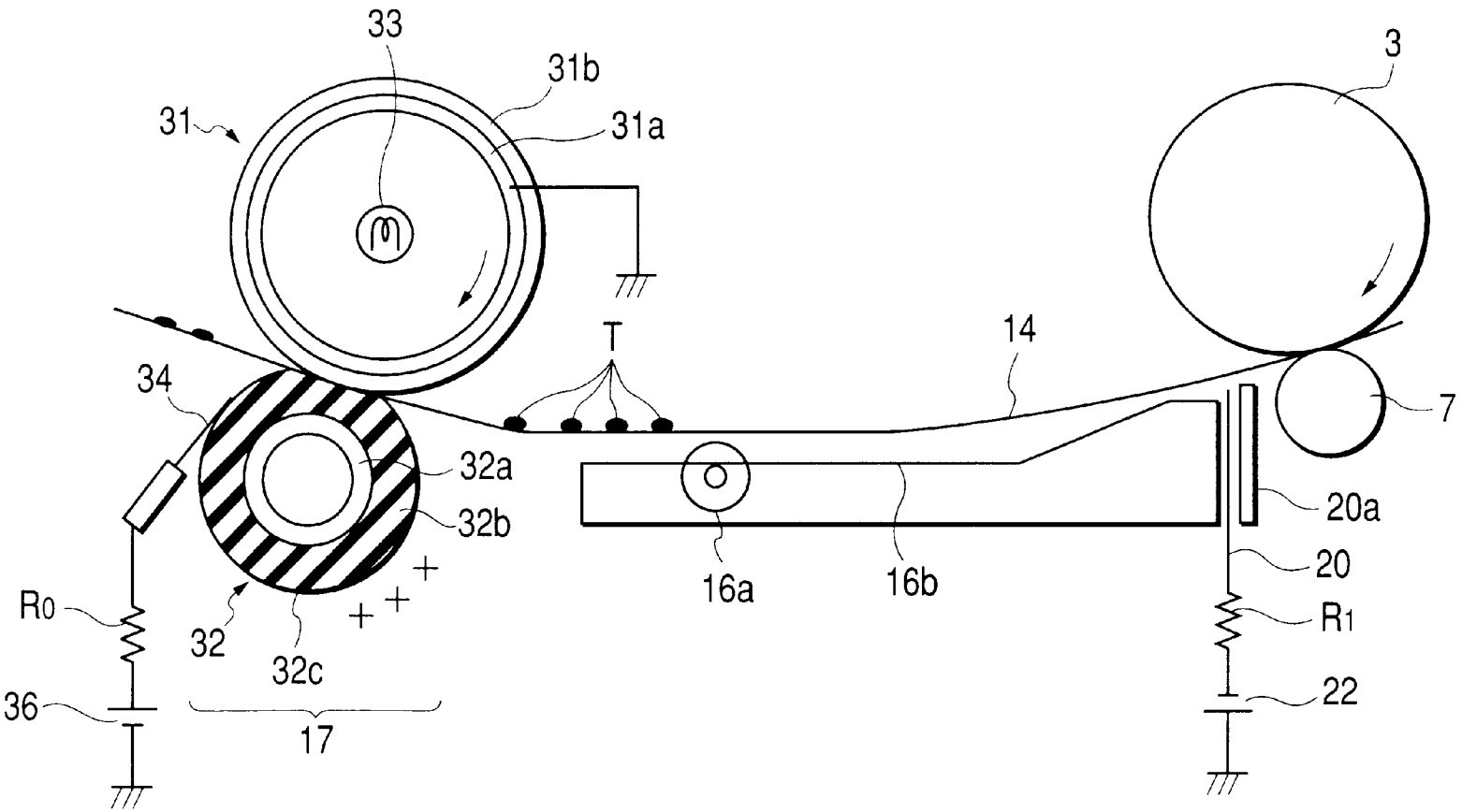
FIG. 2 is a view for explaining a transferring step to a fixing step.

FIG. 2 is a view for explaining a transferring step to a fixing step.

In the present embodiment, in order to separate the paper 14 transferred with the toner image from the photosensitive drum 3, the printer is provided with a residual charge elimination needle 20 of a residual charge elimination means near the photosensitive drum 3, and the paper 14 after transfer is applied with a bias reverse to the polarity of the bias applied to the transferring roller 7 so that the charge on the paper 14 is eliminated and the absorption force between the photosensitive drum 3 and the paper 14 is weakened.

The residual charge elimination means comprises a bias power source 22 which is a power source in addition to the residual charge elimination needle 20, a current-limiting resistor $R_1$ for preventing an electric current leakage by the power source 22, and a residual charge elimination needle holder 20*a* for shielding between the transferring roller 7 and the residual charge elimination needle 20 in order to prevent a leakage of the bias applied to the transferring roller 7 toward the residual charge elimination needle 20.

That is, the residual charge elimination means comprises the power source 22 which is the second power source and the resistor $R_1$ which is the second resistor connected in series to the second power source, and applies a voltage to the recording medium by the second power source through the second resistor.

In this way, the paper 14 which was separated from the photosensitive drum 3 is conveyed to the fixing apparatus 17 by the conveying roller 16*a* and the conveying guide 16*b*.

The fixing apparatus 17 comprises a fixing roller 31 which is a fixing member, a heater 33 which is heating means for heating the fixing roller 31 installed inside the fixing roller 31, and a pressure roller 32 which is pressed against the fixing roller 31 by 20 kgf by pressure means (not shown) and forms a fixing nip.

That is, the fixing means comprises a pair of fixing members, the fixing roller (heating roller) 31 is a first fixing member which contacts an unfixed toner image, the pressure roller 32 is a second fixing member which opposes to the first fixing member and does not contact the unfixed toner image, and the recording medium which bore the unfixed toner image by the fixing nip is held and conveyed, and the unfixed toner image is fixed on the recording medium.

The fixing roller 31 has an electrically conductive fluororesin layer 31*b* formed on a metal core 31*a*.

The pressure roller 32 has a heat resisting silicon rubber elastic layer 32*b* on a metal core 32*a* and, further, a low resisting fluroresin layer 32*c* is formed thereon. Note that the surface resistance of the low resisting fluroresin layer 32*c* of the pressure roller 32 is equal to or less than $10^6$ Ω.

A thermister (not shown) abuts against the surface of the fixing roller 31 with a predetermined abutting pressure, and an electrical circuit (not shown) which is control means is allowed to turn on and off energization to the heater 33 based on the temperature detected by the thermister in such a manner as to make the temperature of the surface of the fixing roller 31 constant during printing.

In this way, the unfixed toner image T is fixed on the paper 14 by being heated and pressurized in the fixing nip.

Voltage applying means comprises an electrically conductive member 34, a first power source 36, and a first resistor $R_0$ connected in series to the first power source 36, and applies a voltage to the second fixing member 32 by the first power source 36 through the first resistor $R_0$.

That is, in the present embodiment, by an electrically conductive brush 34 which is an electrically conductive member and binds together fibers such as stainless, amorphous and the like for supplying an electrical power, a bias reverse to the polarity of the unfixed toner image T is applied on the surface of the pressure roller 32 from the bias power source 36 which is the first power source through the current-limiting resistor $R_0$ which is the first resistor.

Figure 3:
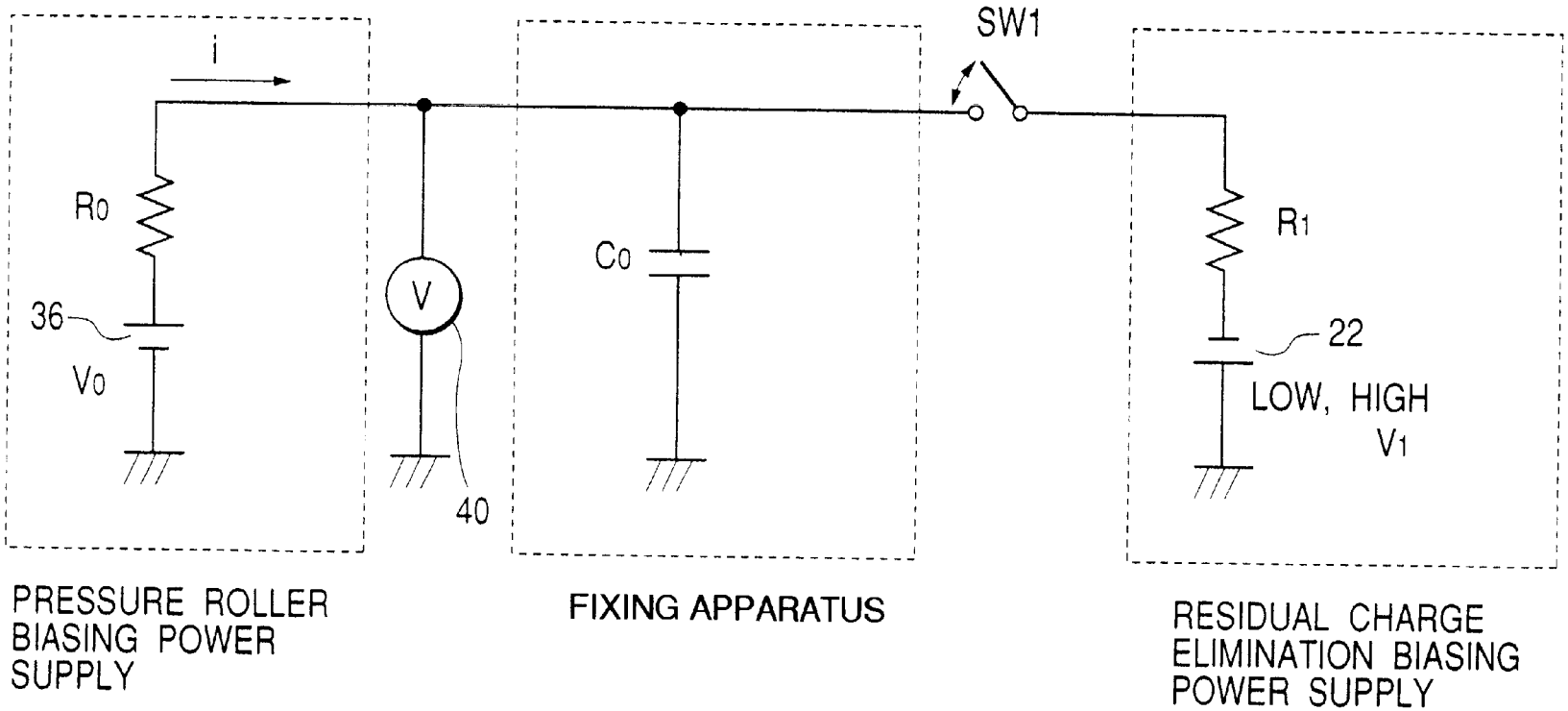
FIG. 3 is a circuit diagram showing a schematic configuration of residual charge elimination means and voltage applying means.

FIG. 3 typically shows the relation among the bias power source 22, the fixing apparatus 17 and the bias power source 36.

In the present embodiment, the recording medium having at least the maximum size exists by extending from the residual charge elimination means to the fixing means.

As shown in FIG. 3, the fixing apparatus 17 is provided with an electrostatic capacity $C_0$, and a bias $V_0$ reverse to the polarity of the toner is applied to the pressure roller 32 inside the fixing apparatus 17 by the DC bias power source 36 through the current-limiting resistor $R_0$. On the other hand, a bias $V_1$ applied to the residual charge elimination needle 20 is applied to the paper 14 by matching a paper feeding timing of the paper 14 from the DC bias power source 22 which connects in series the current-limiting resistor $R_1$. A SW1 is allowed to be in an off-state until the paper 14 reaches the fixing apparatus 17 and in an on-state when the humidified paper reaches the fixing nip. Because the resistance of the humidified paper is small, a space between the fixing apparatus 17 and the residual charge elimination needle 20 is in a short-circuit state. By a voltmeter 40, the voltage of the bias applied to the pressure roller 32 is allowed to be detected.

Conventionally, there have been some cases where before the paper reaches the fixing apparatus 17 (the SW1 is in a state of OFF), the bias applied by the bias power source 36 is accumulated in the pressure roller 32 and becomes a normal state, but when the humidified paper reaches the fixing apparatus 17 (the SW1 is in an ON state), the electric current i flows and the potential of the electrostatic capacity $C_0$, that is, the pressure roller 32 instantaneously falls in a voltage and the black spots of an unfixed image on the paper occurs.

Thus, in the present embodiment, the relation between the voltages $V_0$, $V_1$ by the power source and the current-limiting resistances $R_0$, $R_1$ was set as follows:

$$V_0 \cdot R_1 > V_1 \cdot R_0 \quad (1)$$

In this way, even when the residual charge elimination needle 20 applies a strong residual charge elimination bias to the paper 14 at the paper rear end, the potential fluctuation of the pressure roller 32 is made small and the phenomenon of black spots at the fixing portion is attempted to be prevented.

Figure 4:
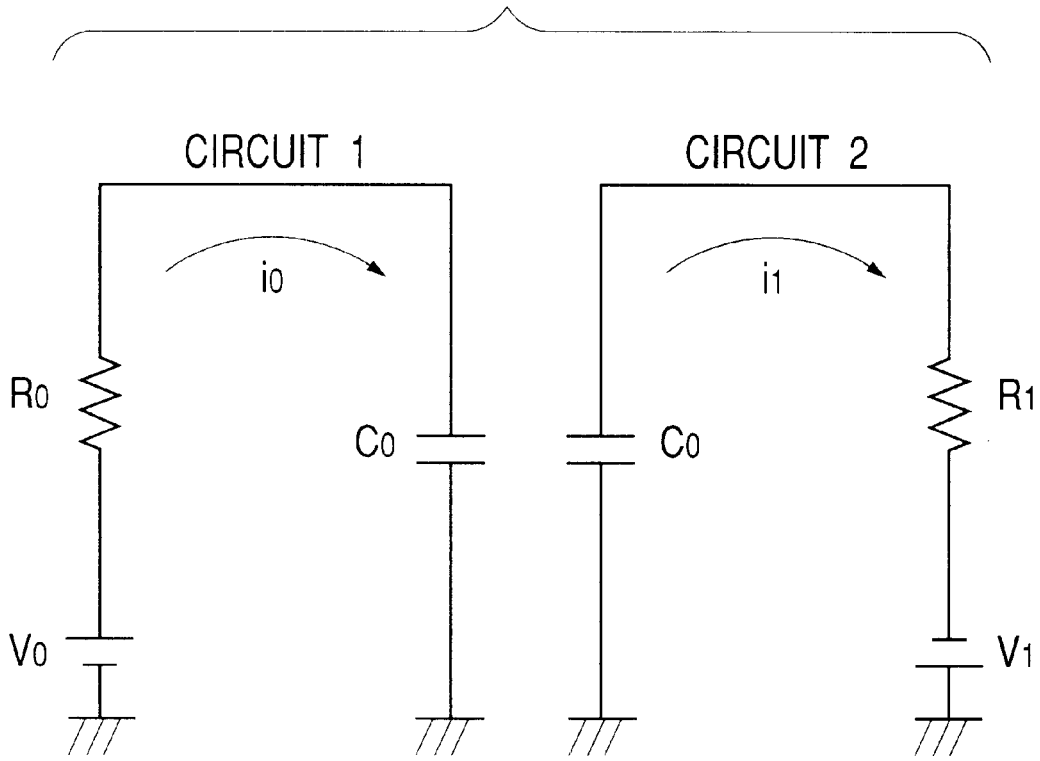
FIG. 4 is the circuit diagram when the circuit shown in FIG. 3 is divided in two parts.

That is, when considering that the circuit of FIG. 3 is divided into two portions as shown in FIG. 4, in order not to allow the potential ($V=Q/C_0$) of the pressure roller 32 to fluctuate, if an electric current $i_0$ which flows in the circuit 1 of FIG. 4 is made larger than the electric current $i_1$ which flows in the circuit 2, the electric current $i_1$ which flows in the paper 14 by the residual charge elimination bias is caught by the electric current $i_0$ supplied from the pressure roller 32 and consequently the charge stored in the electrostatic capacity $C_0$, that is, the potential of the pressure roller 32 does not fluctuate.

The electric currents which flow in the circuit 1, the circuit 2 are, $$i_0=(V_0/R_0)exp(-(1/R_0C_0)t)$$

$$i_1=(V_1/R_1)exp(-(1/R_1C_0)t)$$

and, because a charge is not charged to the electrostatic capacity $C_0$ in the beginning, if t=0, $$i_0=(V_0/R_0)$$

$$i_1=(V_1/R_1),$$

and therefore, to attain $i_0>i_1$, $$V_0/R_0>V_1/R_1$$

$$V_0 \cdot R_1>V_1 \cdot R_0,$$

thus, satisfying the equation (1) is sufficient.

The actual application of the present embodiment to the laser beam printer of the reverse developing which uses a negative toner having a process speed of 200 mm/s will be described.

The present apparatus allows the transferring roller 7 to slavishly rotate on the photosensitive drum 3 and the residual charge elimination needle 20 is arranged in the downstream vicinity of the transferring roller 7. By the residual charge elimination bias power source 22 which connects the current-limiting resistor $R_1$=10 MΩ in series to this residual charge elimination needle 20, with the conveying timing of the paper 14 synchronized, a residual charge elimination bias of a LOW level (−−1 kV) and a HIGH level=−3.0 kV ($-V_1$) at the paper rear end 20 mm were applied and it was possible to make an excellent conveyance and separation.

Further, as a fixing apparatus 17, a pressure roller 32 is abutted against a fixing roller 31 by a pressuring force of 30 kgf and slavishly rotated. On the surface of the pressure roller 32, the electrically conductive brush 34 made of amorphous is abutted, and by the pressure bias power source 36 which connects the current-limiting resistor $R_0$ in series, a pressure bias +1 kV ($=V_0$) was applied synchronized with the rotation of the fixing roller 31.

In this apparatus, when the current-limiting resistor $R_0$ was changed and a voltage drop ΔV of the pressure roller 32 was measured, the result was shown as per TABLE 1. The potential of the pressure roller 32 is the value of the voltmeter 40 of FIG. 3.

TABLE 1

| $R_1$ (MΩ) | $R_0$ (MΩ) | ΔV | Black spots |
|---|---|---|---|
| 10 | 100 | 1250 | BAD |
| 10 | 20 | 700 | NO GOOD |
| 10 | 10 | 450 | NO GOOD |
| 10 | 1 | 10 | GOOD |

In this case, when the current-limiting resistor $R_0$=1 (MΩ), which satisfies $R_0<10/3\cong3.3$ (MΩ) from the equation (1), no black spot of the fixing portion was observed.

Therefore, as described above, according to the present embodiment, if the current-limiting resistors $R_0$, $R_1$ are set for the bias $V_1$ applied to the residual charge elimination needle 20 which is set in advance and the bias $V_0$ applied to the pressure roller 32 in such a manner as to satisfy the relation of the equation (1), the potential fluctuation of the pressure roller 32 under high humidifying circumstance can be made small and black spots at the fixing portion can be prevented.

(Second Embodiment)

Next, the second embodiment of the present invention will be described. Note that the components which are the same as those of the first embodiment are attached with the same reference numerals and the description thereof will be omitted.

In the present embodiment, a capacitor $C_1$ was connected in series to the bias power source $V_0$ applied to the pressure roller 32 and the potential fluctuation of the pressure roller 32 was made small so that the voltage between $R_0$ and $C_1$1 was applied to the pressure roller 32.

Figure 5:
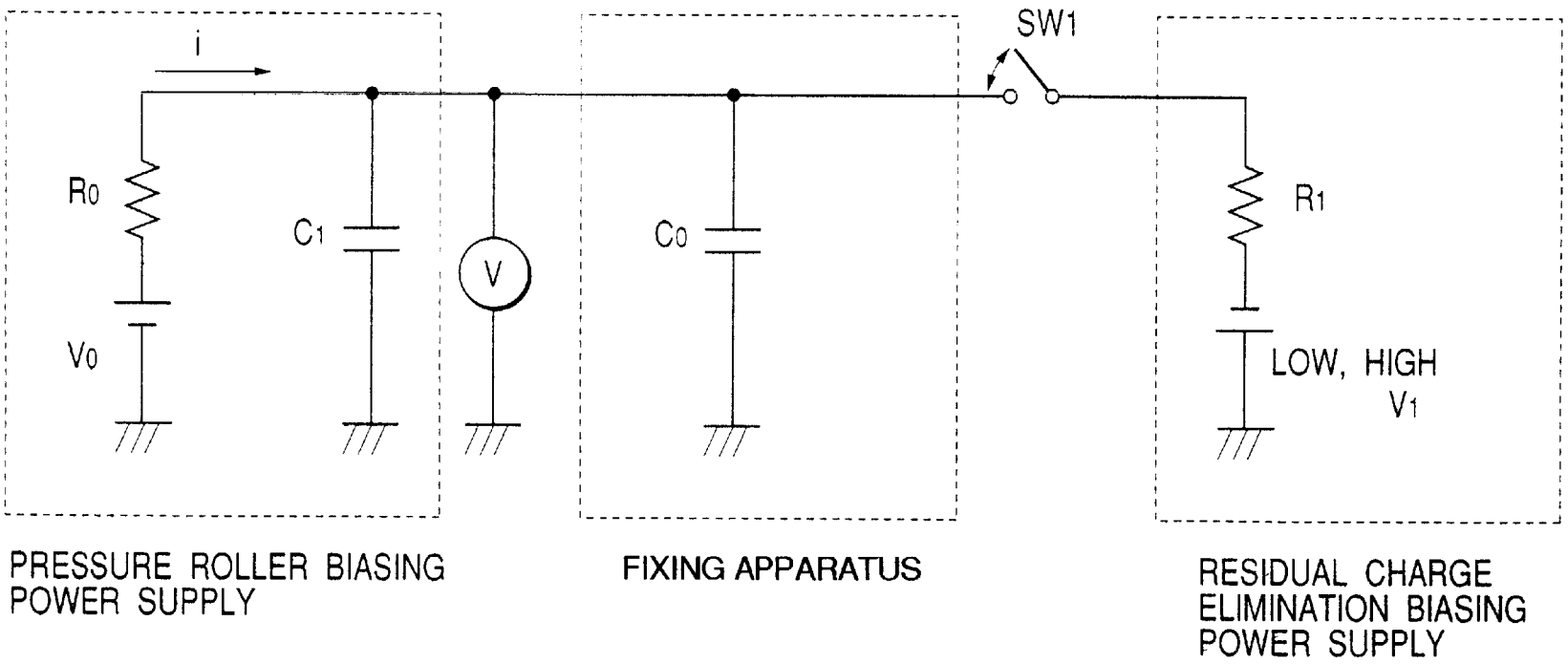
FIG. 5 shows a circuit diagram showing a schematic configuration of the residual charge elimination means and the voltage applying means in another embodiment of the present invention.

That is, because the capacitor $C_1$ is connected in parallel to the electrostatic capacity $C_0$ with which the fixing apparatus 17 is provided in FIG. 5, the fact that the current-limiting resistor $R_0$ and the capacitor $C_1$ serve as the so-called integrating circuit was utilized.

Although the capacity of the capacitor $C_1$ can be randomly set, if the capacitor $C_1$ is too small, comparing with the electrostatic capacity $C_0$ of the fixing apparatus 17, the effect of making the potential fluctuation roller 32 small is minimized and if it is too large, the rise time of the bias applied to the pressure roller 32 slows down and therefore the capacitor capacity of the same level as the electrostatic capacity $C_0$ of the fixing apparatus 17 is preferable.

The actual application of the present embodiment to the same image forming apparatus as the first embodiment will be described.

The electrostatic capacity $C_0$ of the fixing apparatus 17 of the first embodiment was 900 pF owing to the fall time of the pressure bias.

Hence, 1000 pF was connected to a high voltage power source portion of the main body of the image forming apparatus as the capacitor $C_1$, and the potential fluctuation $\Delta V$ of the pressure roller 32 and black spots at the fixing portion were compared. The result is shown in the TABLE 2.

TABLE 2

| $R_1$ (MΩ) | $R_0$ (MΩ) | $C_1$ (pF) | ΔV | Black spots |
|---|---|---|---|---|
| 10 | 10 | 0 | 450 | NO GOOD |
| 10 | 10 | 1000 | 200 | FAIR |

As shown in TABLE 2, by connecting the capacitor $C_1$, the voltage drop of the pressure roller 32 is reduced and a flying image of the fixing portion was alleviated.

Further, in the present embodiment, because the current-limiting resistor $R_0$ which is connected to the bias power source $V_0$ to be applied to the pressure roller 32 can be made large, the safety of the image forming apparatus can be enhanced much more than that of the first embodiment.

(Third Embodiment)

Next, the third embodiment of the present invention will be described. Note that the components which are the same as those of the first embodiment are attached with the same reference numerals and the description thereof will be omitted.

In the apparatus which applies a bias reverse to the polarity of the toner to the pressure roller 32, because a charge is provided to the paper 14 from the surface of the pressure roller 32, when the paper 14 is separated from the surface of the fixing nip, the surface of the fixing roller 31 is subject to separating charge and a potential unevenness occurs on the fixing roller 31. As a result, a flying phenomenon occurs on a fixing roller cycle. Particularly in a high velocity image forming apparatus, because it is necessary to apply a large bias to the pressure roller 32, the potential unevenness on the fixing roller 31 becomes large.

In order to prevent the separating strippable charge on the fixing roller 31 in the paper rear end, when the bias to the pressure roller 32 is turned OFF at a timing in which the paper rear end reaches the fixing nip, the separating charge can be eliminated.

Figure 6:
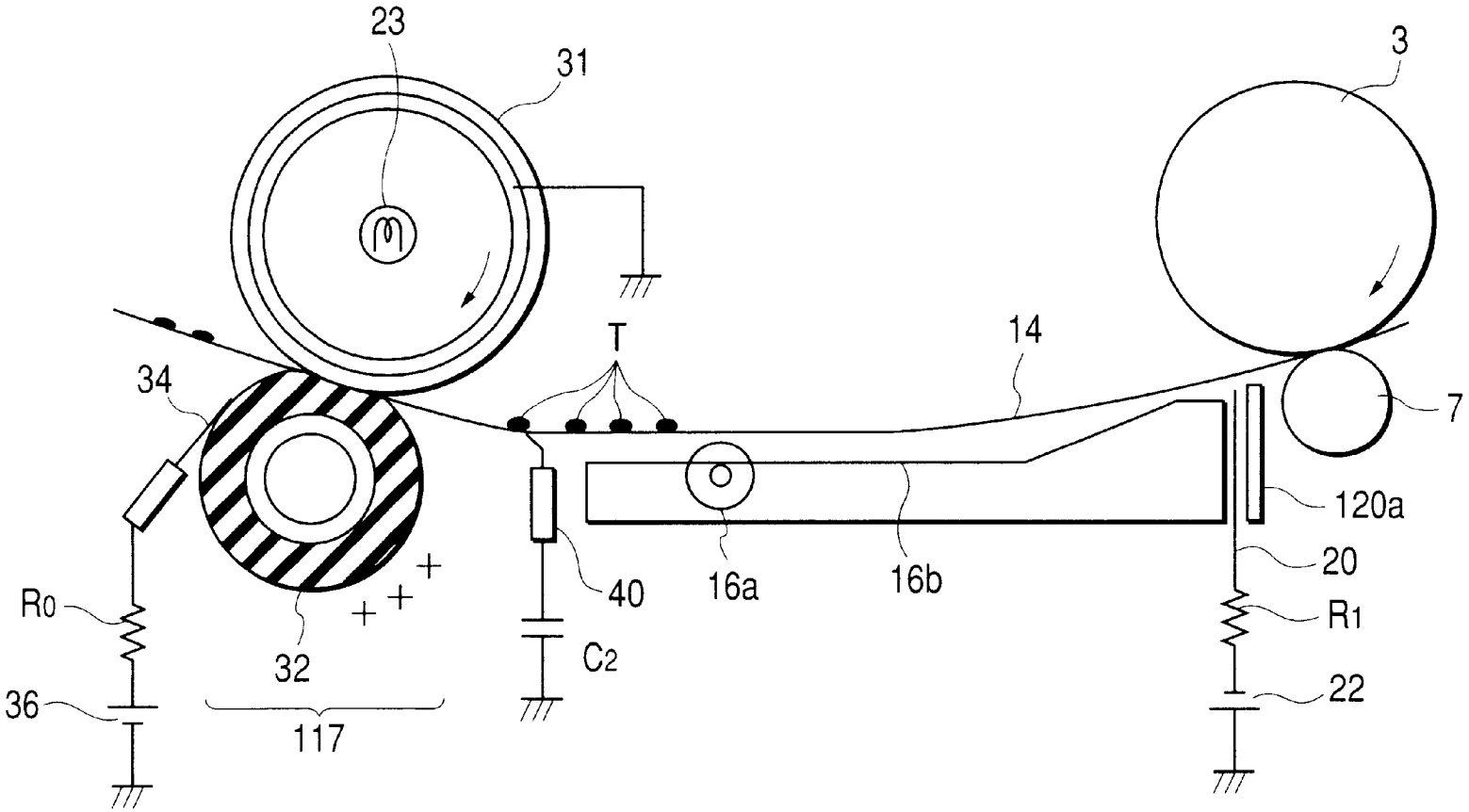
FIG. 6 is a view for explaining the transferring step to the fixing step in another embodiment of the present invention.
Figure 7:
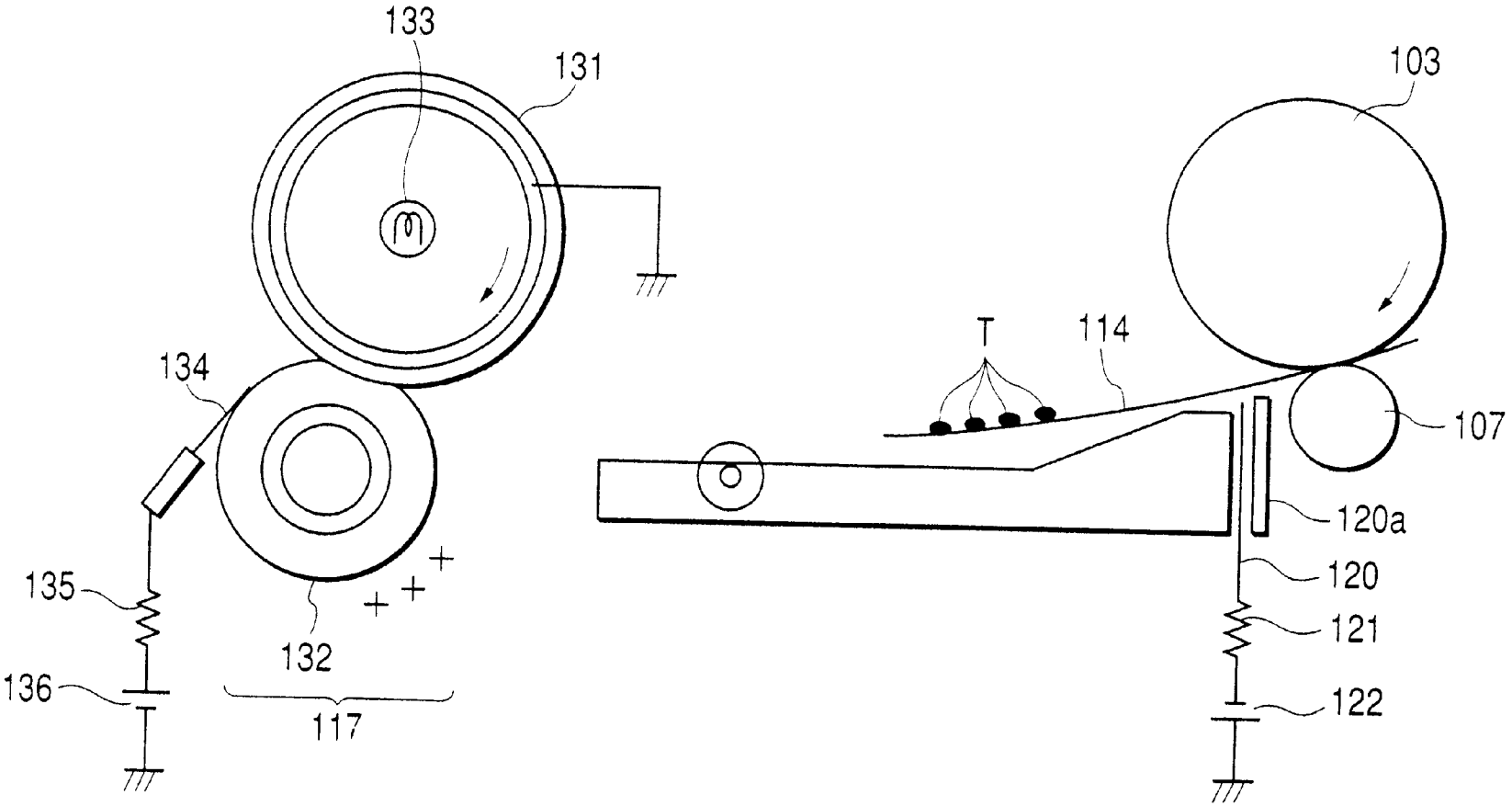
FIG. 7 PRIOR ART
FIG. 7 is a view for explaining the transferring step to the fixing step in the conventional image forming apparatus.
Figure 8:
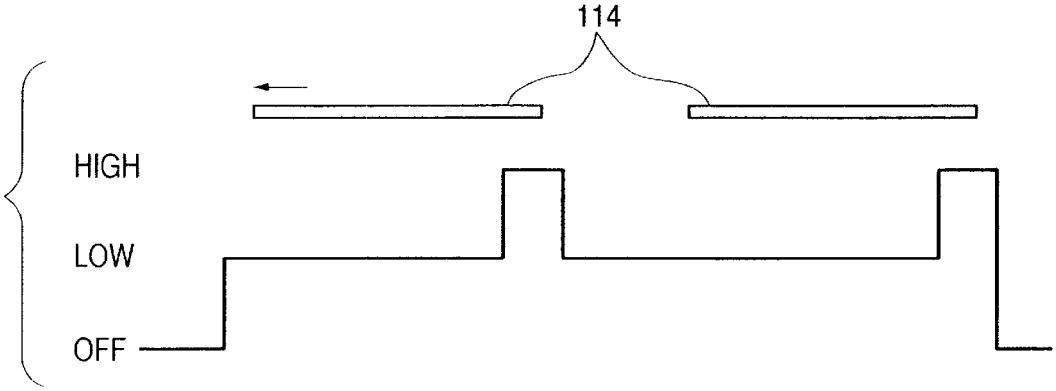
FIG. 8 PRIOR ART
FIG. 8 is a timing chart for showing the applying timing of a bias from a power source to a recording medium by the residual charge elimination means in FIG. 7.
Figure 9:
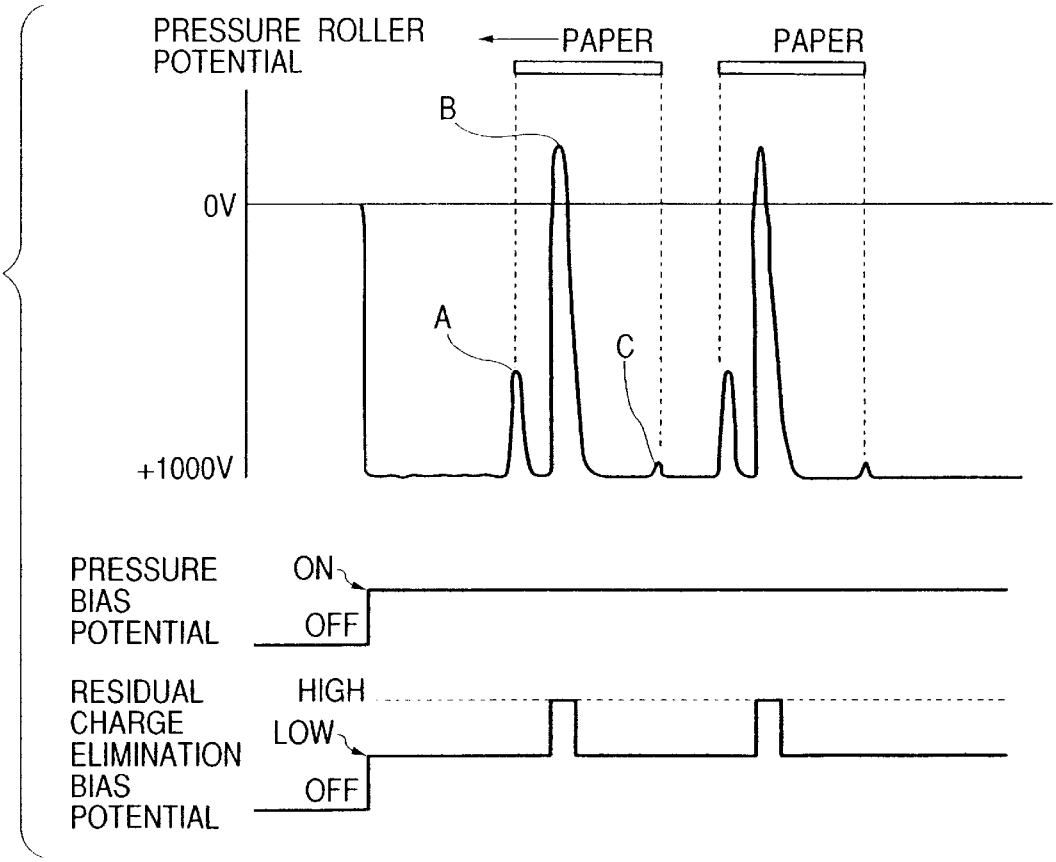
FIG. 9 PRIOR ART
FIG. 9 is a view showing the potential fluctuation of the surface of the pressing body shown in FIG. 7.

In the present embodiment, in the image forming apparatus for turning ON/OFF the applying of a bias to the pressure roller 32 as shown in FIG. 6 by matching the conveying timing of the paper 14, an electrode member 40, which is an electrically conductive member and connects a capacitor $C_2$ in series between the residual charge elimination needle 20 after the transfer and the pressure roller 32, is arranged.

By arranging the capacitor $C_2$ between the residual charge elimination needle 20 and the pressure roller 32, the rise time and the fall time of the pressure bias are kept short because of no capacitor provided for the pressure bias power source portion so that the operation of the integrating circuit can be displayed similar to the second embodiment.

The above described ON/OFF application of the pressure roller bias to the image forming apparatus similar to the first embodiment will be practically described.

When, as a comparative example in the present apparatus, the timing of turning OFF the bias ±1 kV to the pressure roller 32 is set from 20 mm in front before the paper rear end reaches the center of the fixing nip, black spots on the humidified paper does not occur or the surface of the fixing roller 31 is not charged by the paper rear end.

Hence, in the present embodiment, similar to the first embodiment, because the current-limiting resistor $R_0$ of the bias power source which is applied to the pressure roller 32 is taken as 1 MΩ, the fall time of the pressure bias can be made fast as a time constant $R_0 \cdot C_0$=0.9 ms (=0.18 mm) and, before the next paper 14 arrives, the pressure bias can be turned ON.

Furthermore, as the electrode member 40 which connects the capacitor $C_2$ (1000 pF) in series, the electrically conductive brush made of amorphous and SUS was arranged so as to come in contact with the paper 14 to be conveyed and, therefore, even when a bias of −3 kV was applied to the paper rear end by the residual charge elimination needle 20 the flying in the humidified paper did not occur.

Consequently, as described above, according to the present embodiment, this was particularly effective for the image forming apparatus which turns ON/OFF the application of the bias to the pressure roller 32 by matching the conveying timing of the paper 14.

Note that, in the first embodiment to the third embodiment, though the description was made by using the fixing roller 31 as the fixing member, a film may be used as the fixing member.

As described above, according to the present invention, even under high humidity, the potential fluctuation of the pressing body at the time when the recording medium applied with a bias by the residual charge elimination means passes the nip can be controlled and black spots of the toner by the toner image on the recording medium at the time when the recording member passes the nip can be prevented.

While, as above, the embodiments of the present invention were described, the present invention is not intended to be limited to the above described embodiments, but is susceptible to various modifications within the spirit and the scope of the invention.

What is claimed is:

1. An image forming apparatus, comprising:

an image bearing body;

transferring means for transferring an unfixed toner image on said image bearing body to a recording medium;

fixing means for fixing the unfixed toner image on the recording medium to the recording medium, the fixing means including first and second fixing members for conveying the recording medium while nipping the recording medium between the first and second fixing members;

voltage applying means for applying a voltage to the second fixing member which does not come in contact with the unfixed toner image of said fixing means; and charge elimination means for eliminating a charge on the recording medium before the unfixed toner image is fixed by said fixing means;

wherein a recording medium of a maximum size at least extends from said charge elimination means to said fixing means, wherein said voltage applying means comprises a first power source and a first resistor connected in series to said first power source and applies a voltage to said second fixing member from said first power source through said first resistor, wherein said charge elimination means comprises a second power source and a second resistor connected in series to the second power source, and applies a voltage to the recording medium from said second power source through said second resistor, and wherein a voltage value ($V_0$) of said first power source, a resistor value ($R_0$) of said first resistor, a voltage value ($V_1$) of said second power source and a resistor value ($R_1$) of said second resistor, have a relation of $V_0 \cdot R_1 > V_1 \cdot R_0$.

2. An image forming apparatus according to claim 1, wherein said voltage applying means applies a voltage of a polarity opposite to a polarity of the unfixed toner image to a surface of said second fixing member.

3. An image forming apparatus according to claim 1, wherein a surface resistance of said second fixing member is equal to or less than $10^6$ Ω.

4. An image forming apparatus according to claim 1, wherein said first fixing member is a heating roller and said second fixing member is a pressure roller.

5. An image forming apparatus according to claim 1, wherein said charge elimination means applies a voltage of the same polarity as a polarity of the unfixed toner image to the recording medium.

6. An image forming apparatus according to claim 1, wherein said charge elimination means eliminates a charge on the recording medium after transferring by said transferring means.

7. An image forming apparatus, comprising:

an image bearing body;

transferring means for transferring an unfixed toner image on said image bearing body to a recording medium;

fixing means for fixing the unfixed toner image on the recording medium to the recording medium, the fixing means including first and second fixing members for conveying the recording medium while nipping the recording medium between the first and second fixing members;

a voltage applying means for applying a voltage to the second fixing member which does not come in contact with the unfixed toner image of said fixing means; and charge elimination means for eliminating a charge on the recording medium before the unfixed toner image is fixed by said fixing means;

wherein a recording medium of a maximum size at least extends from said charge elimination means to said fixing means, and wherein said voltage applying means comprises a power source, and a resistor and a capacitor which are connected in series to said power source, and applies a voltage between said resistor and said capacitor to said second fixing member.

8. An image forming apparatus according to claim 7, wherein said charge elimination means comprises a power source and a resistor which is connected in series to said power source and applies a voltage to the recording medium by said power source through said resistor.

9. An image forming apparatus according to claim 7, wherein said voltage applying means applies a voltage opposite to a polarity of the unfixed toner image to a surface of said second fixing member.

10. An image forming apparatus according to claim 7, wherein a surface resistance of said second fixing member is equal to or less than $10^6$ Ω.

11. An image forming apparatus according to claim 7, wherein said first fixing member is a heating roller and said second fixing member is a pressure roller.

12. An image forming apparatus according to claim 7, wherein said charge elimination means applies a voltage of the same polarity as a polarity of the unfixed toner image to the recording medium.

13. An image forming apparatus according to claim 7, wherein said charge elimination means eliminates a charge on the recording medium after transferring by said transferring means.

14. An image forming apparatus, comprising:

an image bearing body;

transferring means for transferring an unfixed toner image on said image bearing body to a recording medium;

fixing means for fixing the unfixed toner image on the recording medium to the recording medium, the fixing means including first and second fixing members for conveying the recording medium while nipping the recording medium at a nip where the first and second fixing members contact each other;

voltage applying means for applying a voltage to the second fixing member which does not come in contact with the unfixed toner image of said fixing means; and charge elimination means for eliminating a charge on the recording medium before the unfixed toner is fixed by said fixing means;

wherein a recording medium of a maximum size at least extends from said charge elimination means to said fixing means, wherein said voltage applying means stops applying a voltage to said second fixing member when the rear end of the recording medium arrives at the nip of said fixing means, an electrically conductive member for coming into contact with the recording medium between said charge elimination means and said fixing means, and wherein said electrically conductive member is grounded through a capacitor.

15. An image forming apparatus according to claim 14, wherein said voltage applying means comprises a power source and a resistor connected in series to said power source and applies a voltage to said second fixing member from said power source through said resistor.

16. An image forming apparatus according to claim 14, wherein said charge elimination means comprises a power source and a resistor connected in series to said power source and applies a voltage to the recording medium by said power source through said resistor.

17. An image forming apparatus according to claim 14, wherein said voltage applying means applies a voltage opposite to a polarity of the unfixed toner image to a surface of said second fixing member.

18. An image forming apparatus according to claim 14, wherein a surface resistance of said second fixing member is equal to or less than $10^6$ Ω.

19. An image forming apparatus according to claim 14, wherein said first fixing member is a heating roller and said second fixing member is a pressure roller.

20. An image forming apparatus according to claim 14, wherein said charge elimination means applies a voltage of the same polarity as a polarity of the unfixed toner image to the recording medium.

21. An image forming apparatus according to claim 14, wherein said charge elimination means eliminates a charge on the recording medium after transferring by said transferring means.

* * * * *

UNITED STATES PATENT AND TRADEMARK OFFICE

CERTIFICATE OF CORRECTION

PATENT NO. : 6,560,437 B2 
DATED : May 6, 2003
INVENTOR(S) : Yasunari Kobaru et al.

It is certified that error appears in the above-identified patent and that said Letters Patent is hereby corrected as shown below:

Column 2,
Line 67, “sued” should read -- used --.

Column 3,
Line 65, “objected” should read -- object --.

Column 4,
Line 18, “objected” should read -- object --.

Column 5,
Line 36, “image.,” should read -- image. --.

Column 8,
Line 24, “(-1 kV)” should read -- = -1 kV) --.
Line 25, “($-V_1$)” should read -- ($=V_1$) --.

Signed and Sealed this

Ninth Day of September, 2003

JAMES E. ROGAN
*Director of the United States Patent and Trademark Office*